US008850623B1

(12) United States Patent
Mazzoccoli

(10) Patent No.: US 8,850,623 B1
(45) Date of Patent: Oct. 7, 2014

(54) HELMET WITH ENERGY MANAGEMENT SYSTEM

(71) Applicant: Mazz Enterprises. LLC, Fulshear, TX (US)

(72) Inventor: Jeff C. Mazzoccoli, Fulshear, TX (US)

(73) Assignee: Mazz Enterprises, LLC, Fulshear, TX (US)

( * ) Notice: Subject to any disclaimer, the term of this patent is extended or adjusted under 35 U.S.C. 154(b) by 74 days.

(21) Appl. No.: 13/858,021

(22) Filed: Apr. 6, 2013

(51) Int. Cl.
*A42B 3/12* (2006.01)
*A41D 13/015* (2006.01)
*F16F 7/00* (2006.01)

(52) U.S. Cl.
CPC ..... *A42B 3/122* (2013.01)
USPC ..... 2/413; 2/411; 2/455

(58) Field of Classification Search
CPC ..... A42B 3/121; A42B 3/12; A42B 3/122; A42B 3/064; A42B 3/063; A42B 3/00; A42B 3/065; A42B 3/066; A42B 3/06; A63B 71/10; A63B 71/081; A63B 2220/40; A63B 2220/53
See application file for complete search history.

(56) References Cited

U.S. PATENT DOCUMENTS

| | | | | | |
|---|---|---|---|---|---|
| 3,609,764 | A * | 10/1971 | Morgan | 2/414 |
| 4,239,106 | A * | 12/1980 | Aileo | 206/223 |
| 4,290,149 | A | 9/1981 | Aileo | |
| 4,307,471 | A * | 12/1981 | Lovell | 2/411 |
| 5,313,670 | A * | 5/1994 | Archer, III | 2/411 |
| 5,950,244 | A * | 9/1999 | Fournier et al. | 2/414 |
| 6,081,929 | A * | 7/2000 | Rothrock et al. | 2/171.3 |
| 7,673,350 | B2 * | 3/2010 | Mazzoccoli et al. | 2/411 |
| 8,127,373 | B1 * | 3/2012 | Fodemski | 2/413 |
| 2004/0034903 | A1 * | 2/2004 | Blair | 2/411 |
| 2007/0209098 | A1 * | 9/2007 | Peart | 2/410 |
| 2010/0180362 | A1 * | 7/2010 | Glogowski et al. | 2/411 |
| 2010/0180363 | A1 | 7/2010 | Glogowski et al. | |
| 2010/0251451 | A1 * | 10/2010 | Feldman et al. | 2/2.5 |
| 2011/0047685 | A1 * | 3/2011 | Ferrara | 2/455 |
| 2011/0175334 | A1 * | 7/2011 | Miller et al. | 280/730.2 |
| 2011/0296594 | A1 * | 12/2011 | Thomas et al. | 2/414 |
| 2012/0102630 | A1 * | 5/2012 | Anderson | 2/413 |
| 2012/0151664 | A1 * | 6/2012 | Kirshon | 2/413 |
| 2012/0198604 | A1 * | 8/2012 | Weber et al. | 2/414 |
| 2012/0233745 | A1 | 9/2012 | Veazie | |

* cited by examiner

*Primary Examiner* — Bobby Muromoto, Jr.
(74) *Attorney, Agent, or Firm* — Antoinette M. Tease

(57) ABSTRACT

An energy management system having a helmet shell, at least one pocket situated on an inside surface of the helmet shell and having an outer surface, and a bladder positioned inside of the at least one pocket. The outer surface of the at least one pocket allows the bladder to extend beyond the outside surface of the pocket upon impact.

12 Claims, 6 Drawing Sheets

HELMET WITH ENERGY MANAGEMENT SYSTEM

BACKGROUND OF THE INVENTION

1. Field of the Invention

The present invention relates generally to the field of protective head gear, and more specifically, to a helmet with an energy management system comprised of extendable bladders within strategically arranged foam pockets.

2. Description of the Related Art

The present invention is intended to provide a superior energy management system for avoiding or minimizing injuries to persons from projectiles (such as baseballs) or other impacts to the head, vibrations and other forces. Although the present invention is not limited to the field of athletics, the energy management system of the present invention may be used in connection with baseball, football, hockey and other helmets, as well as other protective gear. A number of devices that are intended to provide protection to the head of an athlete during competition or practice have been patented or are the subject of pending patent applications, but none incorporates a bladder system that allows the bladder to extend beyond the confines of the helmet.

Despite the relative perceived safety of baseball as opposed to some other sports, there have been a number of injuries and even deaths caused by a baseball hitting a player's head at a high speed and/or at an area of the head (such as the temporal area) that can cause serious injury. U.S. Pat. No. 7,673,650 (Mazzoccoli, 2010) which discloses a Universal Safety Cap with flexible foam joints that absorb energy and allow the helmet to flex upon impact. The present invention incorporates bladders within foam pockets. These bladders and foam pockets may be used with or without the flexible joints of the prior invention. Additional examples of prior art are described below.

U.S. Pat. No. 3,609,764 (Morgan, 1971) provides an energy absorbing and sizing means for helmets. The helmet comprises a first set of chambers on the inside surface of the helmet with a substantially non-compressible fluid within these chambers. The helmet further comprises a second set of chambers, and the fluid within the first set of chambers is allowed to expand into the second set of chambers upon impact. This fluid returns to the first chambers when the force of the impact is removed. A constricted passage connects the first and second chambers. The chambers are comprised of a flexible material that is sealed to form a fluid-tight chamber. The size of each chamber is controlled by heat sealing. These chambers (or bladders) are not situated within foam pockets, and they do not extend beyond the confines of the helmet upon impact.

U.S. Pat. Nos. 4,239,106 (Aileo, 1980) and 4,290,149 (Aileo, 1981) both disclose an individually fitted helmet. The helmet is comprised of resilient, snugly fitting spacer plugs that can be pushed inwardly to adjust the fit of the helmet around the wearer's head. Although the invention is not touted as an energy management system, it is conceivable that the plugs would absorb at least some energy upon impact.

U.S. Pat. No. 4,307,471 (Lovell, 1981) involves a helmet designed to protect sportsmen or workers in potentially hazardous occupations. The helmet comprises a hard shell within an outer section that is slidably connected to an inner section. Specifically, the outer section moves relative to the inner section upon impact. In an alternate embodiment, the helmet further comprises a plurality of cushioning projections that are situated between the outer and inner shells and attached to one of the shells.

U.S. Pat. No. 5,950,244 (Fournier et al., 1999) provides a protective device (helmet) for impact management. The device comprises a shell and a liner. The liner comprises a means for enabling controlled displacement of preselected regions of the liner upon various degrees of impact to the outer shell. The liner is preferably attached to the outer shell with a hook-and-loop fastener. The liner is comprised of a first material with holes into which a second material is inserted. The first and second materials have different impact-absorbing characteristics.

U.S. Patent Application Pub. No. 2007/0209098 (Peart) discloses a helmet with interior ventilation chambers. The interior ventilation chambers are created by pads protruding inwardly from an interior protective layer of the helmet. The pads define a network of interconnected ventilation channels, which allow for air circulation between the protective layer and the wearer's head. Although this patent application does not discuss energy management per se, the pads may provide some level of energy absorption.

U.S. Patent Application Pub. Nos. 2010/0180362 and 2010/0180363 (Glogowski et al.) describe an adjustable fitting helmet in which the wearer may adjust the size, shape, orientation and/or pressure of the helmet. In one embodiment, the helmet comprises an outer shell and an impact-absorbing liner with at least two pads coupled to it. An inflatable bladder is situated between the outer shell and the pads so that when the bladder is inflated, it causes the pads to move closer to the head of the wearer, thereby adjusting the fit of the helmet.

U.S. Patent Application Pub. No. 2011/0296594 (Thomas et al.) involves an energy management structure comprised of a first compressive response profile, a second compressive response profile, and a third component connecting the two. The second component surrounds the first component so that there is a recess between them. The first, second and third components form a cup-like structure that is attached to the inside of a helmet. The structures may vary in stiffness. In a preferred embodiment, a plurality of these structures is positioned inside the helmet to provide the desired energy management.

U.S. Patent Application Pub. No. 2012/0151664 (Kirson) provides a helmet safety liner for use with a motorcycle helmet. The liner is a liquid-gel impact reaction liner that is secured directly to the inside of the helmet. The liner has a fluid sack layer that contains fluid. The fluid sack has a plurality of doughnut-shaped holes that are surrounded by a liner opening inner wall and a liner opening outer wall. The fluid sack layer allows expansion or contraction of the doughnut-shaped holes.

U.S. Patent Application Pub. No. 2012/0198604 (Weber et al.) discloses an "omnidirectional" energy management system for a helmet. The helmet comprises an outer shell, an outer liner and an inner liner, and a plurality of isolation dampers between the inner and outer liners. The inner liner moves relative to the outer liner upon impact, and the isolation dampers are configured to cause the inner liner to return to its original position relative to the outer liner after the force of the impact is removed. The isolation dampers are described as having a "wide range of configurations and materials."

U.S. Patent Application Pub No. 2012/0233745 (Veazie) describes an impact absorbing helmet system comprised of an outer shell and a more rigid inner shell. Sealed elastomer energy absorbing cells containing a gas or liquid are situated between the inner and outer shells. The outer shell and cells deform upon impact.

There is a need for improvement in the field of protective head gear, and in particular, in the field of energy management systems. Current energy management systems do not enable the construction of a pitcher or defensive player's helmet thin enough to disguise it under a baseball hat while still being protective of the player at energy levels associated with a hit baseball. Exit velocities of baseballs hit in competition can reach as high as 100-120 mph at the high school to professional level. Baseball impact tests are performed by colliding a baseball with a National Operating Committee on Standards for Athletic Equipment (NOCSAE) headform (having an embedded triaxial accelerometer). The test results are measured in terms of the industry standard Severity Index (SI). Tests run on the present invention prove that it is superior to other energy management systems because it has the lowest SI value.

Specifically, the present invention improves upon the deficiencies in the prior art by utilizing stretchable bladders within strategically placed foam pockets. The foam pockets direct the deformation and stretching of the bladders upon impact and allow the bladders to stretch and extend beyond the confines of the helmet. The present invention reduces the amount of energy transmitted to the head by redirecting the energy of impact around and away from the point of impact. The impact causes material contained in the bladder to move, and it also causes the bladder to stretch and deform. The material movement and the bladder stretching and deformation absorb energy during impact, thus preventing it from causing damage to the head of the wearer.

BRIEF SUMMARY OF THE INVENTION

The present invention is an energy management system comprising: a helmet shell having a bottom edge; a plurality of bell-shaped pockets situated on an inside surface of the helmet shell, each of the bell-shaped pockets having a bottom surface; and a bladder positioned inside of each bell-shaped pocket; wherein the bottom surface of each bell-shaped pocket is configured to allow the bladder to extend beyond the bottom surface of the pocket and beyond the bottom edge of the helmet upon impact.

In a preferred embodiment, each bell-shaped pocket further comprises a first curved side wall, a second curved side wall, a neck area a first throat area, and a second throat area, and the first curved side wall extends from the bottom surface to the first throat area, and the second curved side wall extends from the bottom surface to the second throat area, the first throat area is situated between the first curved side wall and the neck, and the second throat area is situated between the second curved side wall and the neck, and the first and second curved side walls and the neck area are affixed to the inside surface of the helmet shell, and wherein the first and second throat areas are configured to allow the bladder to extend outside of the pocket through the first and second throat areas upon impact. Preferably, each bladder comprises a vertical groove that extends downward along a vertical axis of the bladder from an apex of the bladder to a point between the apex and a center point on the vertical axis.

In an alternate embodiment, the present invention is an energy management system comprising: a helmet shell having a bottom edge and a top; a plurality of pockets situated on an inside surface of the helmet shell and extending from the bottom edge of the helmet shell to the top of the helmet shell, each pocket having a bottom surface and a top edge that is open to the top of the helmet shell; and a bladder positioned inside of each pocket; wherein the bottom surface of each pocket is configured to allow the bladder to extend beyond the bottom surface of the pocket and beyond the bottom edge of the helmet upon impact.

In a preferred embodiment, each pocket comprises a first side wall and a second side wall, and the first and second side walls are affixed to the inside surface of the helmet shell. Preferably, the pockets cover at least half of the inside surface of the helmet shell.

In another alternate embodiment, the present invention is an energy management system comprising: a helmet shell having a bottom edge and a top; a first row of pockets and a second row of pockets situated on an inside surface of the helmet shell, the first row of pockets being situated on top of the second row of pockets, each pocket in the first row having a top edge that is open to the top of the helmet, and each pocket in the second row having a bottom surface; and a bladder positioned inside of each pocket in the first row of pockets and each pocket in the second row of pockets; wherein the bottom surface of each pocket in the second row of pockets is configured to allow the bladder within the pocket to extend beyond the bottom surface of the pocket and beyond the bottom edge of the helmet upon impact.

In a preferred embodiment, the invention further comprises a center wall between each pocket in the first row of pockets and each pocket in the second row of pockets, and the center wall is configured to allow the bladder within each of the pockets in the first row of pockets and the bladder within each of the pockets in the second row of pockets to extend beyond the center wall. Preferably, each pocket in the first row of pockets comprises a first side wall and a second side wall, each pocket in the second row of pockets comprises a first side wall and a second side wall, and the first and second side walls of the packets in the first and second rows are affixed to the inside surface of the helmet shell. The pockets in the first and second rows preferably cover at least half of the inside surface of the helmet shell.

In all of the above embodiments, the bladder has a top and a bottom, and the bladder is preferably thicker at the bottom than at the top.

The present invention is an energy management system comprising: a helmet shell; at least one pocket situated on an inside surface of the helmet shell and having an outer surface; and a bladder positioned inside of the at least one pocket; wherein the outer surface of the at least one pocket is configured to allow the bladder to extend beyond the outside surface of the pocket upon impact.

The present invention is an energy management system comprising: a helmet shell having a bottom edge; at least one pocket situated on an inside surface of the helmet shell and having a bottom surface; and a bladder positioned inside of the at least one pocket; wherein the bottom surface of each pocket is aligned with the bottom edge of the helmet shell; and wherein the bottom surface of each pocket is configured to allow the bladder to extend beyond the bottom surface of the pocket and beyond the bottom edge of the helmet upon impact.

REFERENCE NUMBERS

Figure 1:
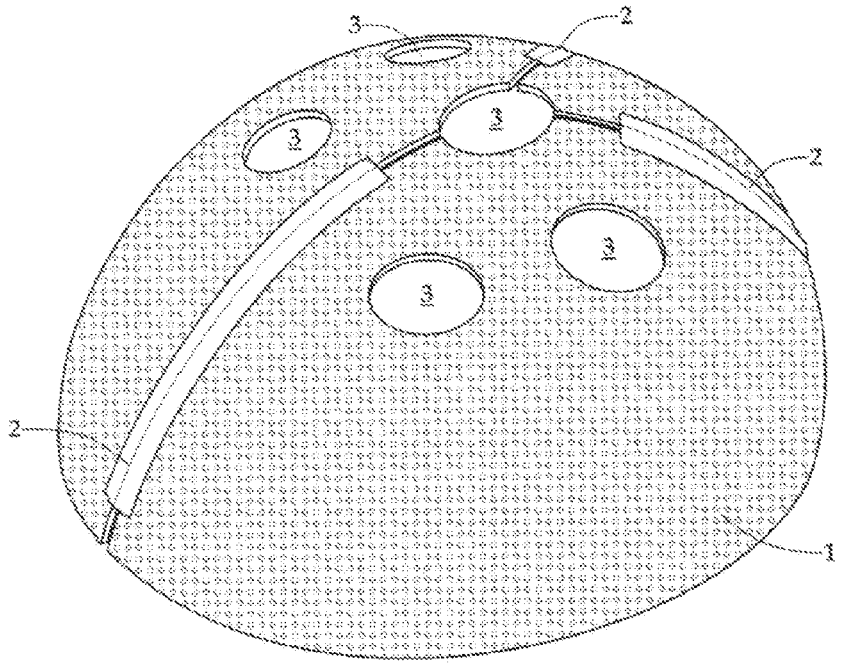
FIG. 1 is a top perspective view of a standard helmet with seams and ventilation holes.

1 Helmet/helmet shell
2 Seam
3 Ventilation hole
4 Bell-shaped foam pocket
5 Bottom surface (of bell-shaped foam pocket)
6 Curved side wall (of bell-shaped foam pocket)
7 Throat area (of bell-shaped foam pocket)
8 Neck (of bell-shaped foam pocket)
9 Bottom edge (of helmet shell)
10 Foam stabilizer
11 Bell-shaped bladder
12 Bottom edge (of bell-shaped bladder)
13 Curved side wall (of bell-shaped bladder)
14 Apex (of bell-shaped bladder)
15 Depression
16 Magnet (on foam pocket)
17 Thin, stretchy material
18 Glue/adhesive
19 Baseball
20 Magnet (on helmet shell)
21 Vertically oriented foam pocket
22 Top edge (of vertically oriented foam pocket)
23 Bottom edge (of vertically oriented foam pocket)
24 Side wall (of vertically oriented foam pocket)
25 Bottom surface (of vertically oriented foam pocket)
26 Underside (of vertically oriented foam pocket)
27 Stacked foam pocket
28 Top edge (of stacked foam pocket)
29 Bottom edge (of stacked foam pocket)
30 First embodiment of bladder (for vertically oriented foam pocket)
31 First embodiment of bladders (for stacked foam pockets)
32 Second embodiment of bladder (for vertically oriented foam pocket)
33 Second embodiment of bladders (for stacked foam pockets)
34 Cut-out/window (in bottom surface of pocket)
35 Center wall (between stacked foam pockets)

DETAILED DESCRIPTION OF INVENTION

FIG. 1 is a top perspective view of a standard helmet with seams and ventilation holes. The present invention may be used with any helmet design, and the helmet shown in FIG. 1 is for illustrative purposes only. The helmet 1 of FIG. 1 comprises one or mom seams 2 that allow the helmet 1 to flex upon impact, but the present invention does not require seams 2. Because the seams provide for flexibility, they offer advantages over non-seamed designs. The seams ensure proper fit and help to maintain proper distance between the shell and the head, thus optimizing protection with the thinnest possible profile. Otherwise, custom fitting is required to achieve the same performance. The helmet 1 also comprises one or more ventilation holes 3, which, like the seams 2, are preferred but not necessarily required.

Figure 2:
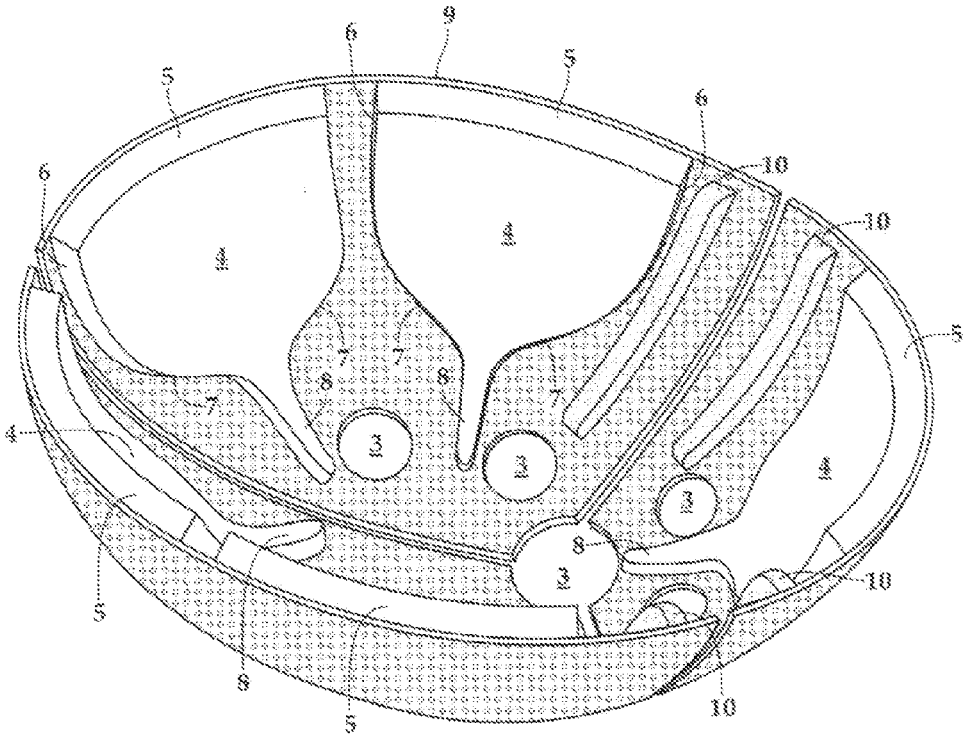
FIG. 2 is a bottom perspective view of the helmet shown in FIG. 1 with the bell-shaped foam pockets of the present invention.

FIG. 2 is a bottom perspective view of the helmet shown in FIG. 1 with the bell-shaped foam pockets of the present invention. The energy management system of the present invention is installed on the inside of a helmet shell (like the one shown in FIG. 1). In this embodiment of the invention, a plurality of bell-shaped pockets 4 comprised of foam, fabric, plastic, or any combination of the foregoing, are installed on the inside surface of the helmet shell 1. Preferably, the pockets 4 are comprised of a material that is flexible, compressible and comfortable when worn against the head.

Each bell-shaped foam pocket 4 comprises a bottom surface 5, two curved side walls 6, two throat areas 7 on either side of the pocket 4, and a neck 8. The pockets 4 are preferably situated so that the throat areas 7 are in proximity to at least one ventilation hole 3 (sec also FIG. 3). The bottom surfaces 5 of the pockets 4 are preferably configured so that they extend along a portion of the bottom edge 9 of the helmet shell 1 (i.e., the bottom surfaces of the pockets are aligned with the bottom edge of the helmet shell). The curved side walls 6 extend from the bottom surface 5 to the throat area 7. The throat areas 7 are situated between the curved side walls 6 and the neck 8.

Optional foam stabilizers 10, which are not limited to any particular size or shape, may be installed (preferably with glue or other adhesive) on the inside of the helmet shell 1 to provide for added comfort and cushioning. In addition to helping stabilize the helmet shell and bladders, the foam stabilizers 10 also serve to contain and direct the path of bladder stretching when the bladders emerge from the throat area 7 of the pocket 4 upon impact.

In the embodiment shown in FIGS. 1 and 2, the bottom surface and throat areas of the bell-shaped pockets are both "outside surfaces" of the pocket through which the bladder is allowed to extend upon impact. As used in the claims, the term "outer surface" means any outer surface of the pocket, regardless of the particular shape of the pocket.

Figure 3:
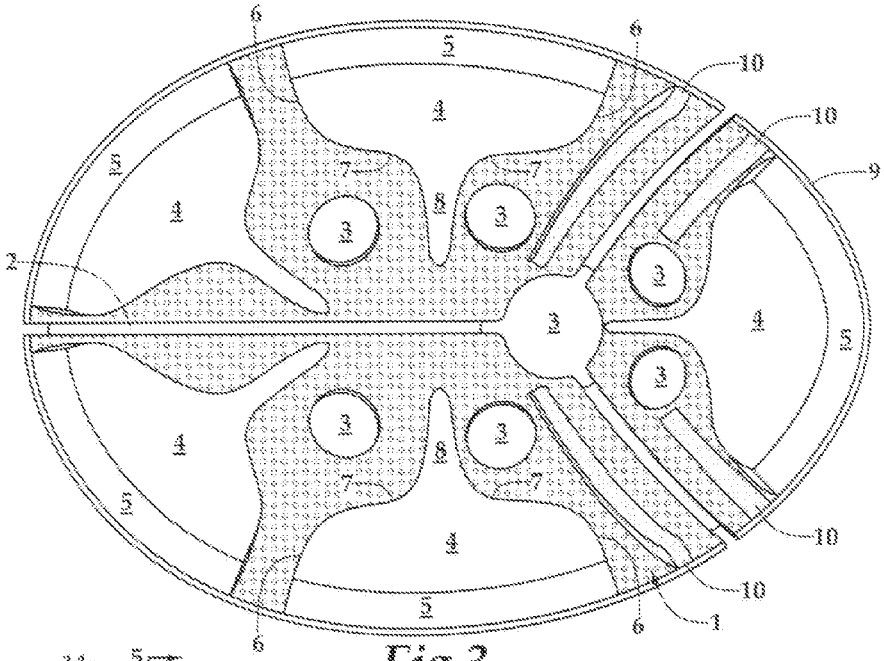
FIG. 3 is a bottom view of the helmet shown in FIG. 2.

FIG. 3 is a bottom view of the helmet shown in FIG. 2. FIGS. 2 and 3 depict a first embodiment of the bell-shaped foam pocket 4 in which the bottom surface 5 of the pocket 4 is removably attached to the inside of the helmet shell 1 with magnets (not shown).

Figure 4:
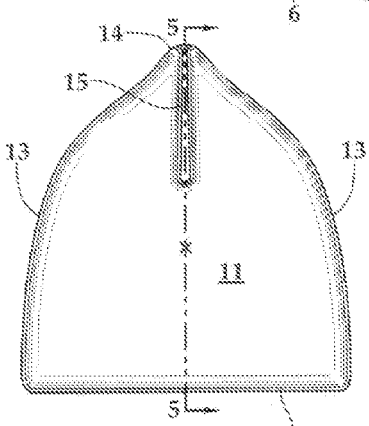
FIG. 4 is a plan view of one of the bell-shaped bladders of the present invention.

FIG. 4 is a plan view of one of the bell-shaped bladders of the present invention. In a preferred embodiment, a bell-shaped bladder 11 is positioned inside of each bell-shaped foam pocket 4. The bell-shaped bladder 11 is comprised of an external membrane (such as, by way of example and not limitation, thermoplastic elastomer, latex rubber, or silicon rubber) and an internal material. The bladder is filled with an internal material comprises of a gas, a fluid, a semi-solid material, a solid, or any combination of the foregoing. Any solid or semi-solid material filling must move with or in a fashion equivalent to liquid or gas flow upon impact, causing bladder deformation, stretching, and extension. The purpose of the bell-shaped bladder 11 is to absorb energy (by deforming and stretching) when the helmet is impacted. The purpose of the bell-shaped pockets 4 is to direct deformation, stretching, and extension of the bladder 11 in a particular direction or directions, as explained more fully below.

The bladder 11 shown in FIG. 4 is preferably bell-shaped with a rounded bottom edge 12, two curved side walls 13, and an apex 14. The curved side walls 13 extend from the bottom edge 12 to the apex 14. The bladder 11 does not have a neck area 8 as do the foam-pockets 4. The bladder 11 is preferably shaped roughly the same as the bell-shaped foam pockets 4 except for the neck area 8.

In addition, the bladder 11 preferably comprises a depression 15 in the shape of a vertical groove that extends downward along the vertical axis of the bladder (indicated in FIG. 4 by the cross-section line for FIG. 5) from the apex 14 to a point short of the center point (indicated with an "x" in FIG. 4) on the vertical axis. This depression 15 helps direct the stretching and extension of the bladder 11 through the throat areas 7 and not up into the neck area 8 of the bell-shaped pockets 4. It also helps direct stretching and extension of the bladder 11 downward (through the bottom surface 5 of the pocket 4). In addition, the depression 15 helps control the thickness of the bladder relative to its position in the foam pocket. For example, the depicted configuration causes the bladder to be thicker as it nears the bottom edge 9 of the shell.

Figure 5:
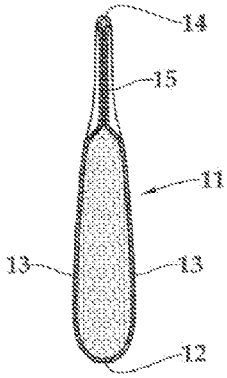
FIG. 5 is a side view of the bladder shown in FIG. 4.

FIG. 5 is a side view of the bladder shown in FIG. 4. As shown in this figure, the lower part of the bladder 11 is preferably thicker than the upper part.

Figure 6:
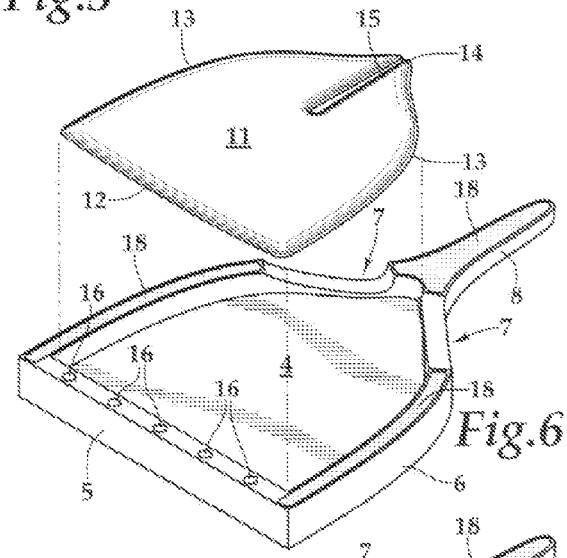
FIG. 6 is an exploded view of a first embodiment of the bell-shaped foam pocket and bell-shaped bladder of the present invention.

FIG. 6 is an exploded view of a first embodiment of the bell-shaped foam pocket and bell-shaped bladder of the present invention. As shown in this figure, the throat areas 7 of the bell-shaped pockets 4 are preferably cut out to allow the bladder 11 to stretch and extend through the throat areas 7 upon impact. In this embodiment of the foam pocket 4, a first plurality of magnets 16 is equally spaced along the inside of the foam pocket 4 adjacent to the bottom surface 5. When the foam pocket 4 is installed in the helmet shell 1, these magnets 16 line up with a second plurality of magnets (not shown) on the inside of the helmet shell 1. The first and second plurality of magnets preferably have opposite poles. In lieu of using the plurality of magnets, a magnetic strip (not shown) could be used both on the foam pocket and on the helmet shell. Furthermore, the magnets 16 need not be equally spaced, and a single magnet could be used.

The purpose of the magnets 16 is to allow the bottom of the bladder 11 to exit the pocket 4 and extend downward (outside of both the pocket 4 and the helmet shell 1) upon impact. If sufficient force is applied by the bladder 11 against the bottom surface 4 of the foam pocket 4, the magnets 16 will decouple from the magnets (not shown) on the helmet shell, and the bottom of the pocket 4 will open. In this manner, the bladder 11 may extend downward below the bottom edge 9 of the helmet shell 1. High-speed videos of the present invention show the bladder 11 extending a significant distance downward (beyond the confines of the helmet) and then retracting back up into the foam pocket 4. In a preferred embodiment, the bladder 11 has the ability to extend multiple times its original length. The magnets 16 are preferably small, cylindrical ceramic magnets.

Figure 6A:
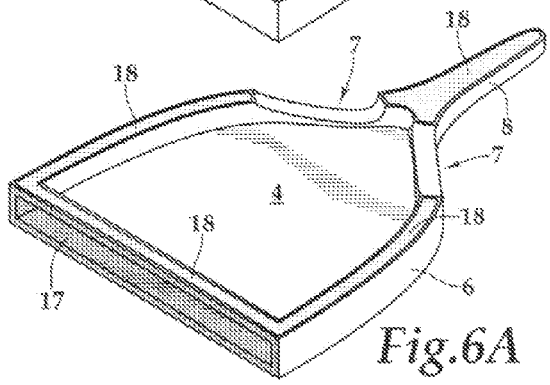
FIG. 6A is a perspective view of a second embodiment of the bell-shaped foam pocket of the present invention.

FIG. 6A is a perspective view of a second embodiment of the bell-shaped foam pocket of the present invention. This figure shows an alternate embodiment of the foam pocket 4 in which the bottom surface 5 comprises a layer of thin, stretchy material (preferably nylon or LYCRA®) 17 that extends across the entire bottom surface 5 of the pocket 4. The bottom surface 5 comprises a cut-out 34 (or window) through which the bladder 11 may stretch and extend upon impact. The thin, stretchy material 17 allows the bladder 11 to extend downward outside of the pocket 4 (and outside of the helmet shell 1). The material 17 prevents dirt and debris from coming into contact with the bladder 11. The material 17 is preferably adhered to the bottom surface 5 of the pocket 4 with an adhesive.

In both of the embodiments of the foam pocket 4 shown in FIGS. 6 and 6A, the neck area 8 of the pocket 4 is glued to the inside surface of the helmet shell 1. The glue (or other adhesive) 18 is labeled in FIGS. 6 and 6A to show which parts of the pocket 4 are adhered to the shell 1. Alternately, those portions of the pockets 4 that are shown with glue 18 may be affixed to the inside surface of the helmet shell with a hook-and-loop fastener, magnets, or other fastening device, as long as these other fastening devices would accomplish the purpose of directing the bladder downward and upward (through the throat areas) upon impact.

Figures 7A, 7B, 7C, 7D, 7E:
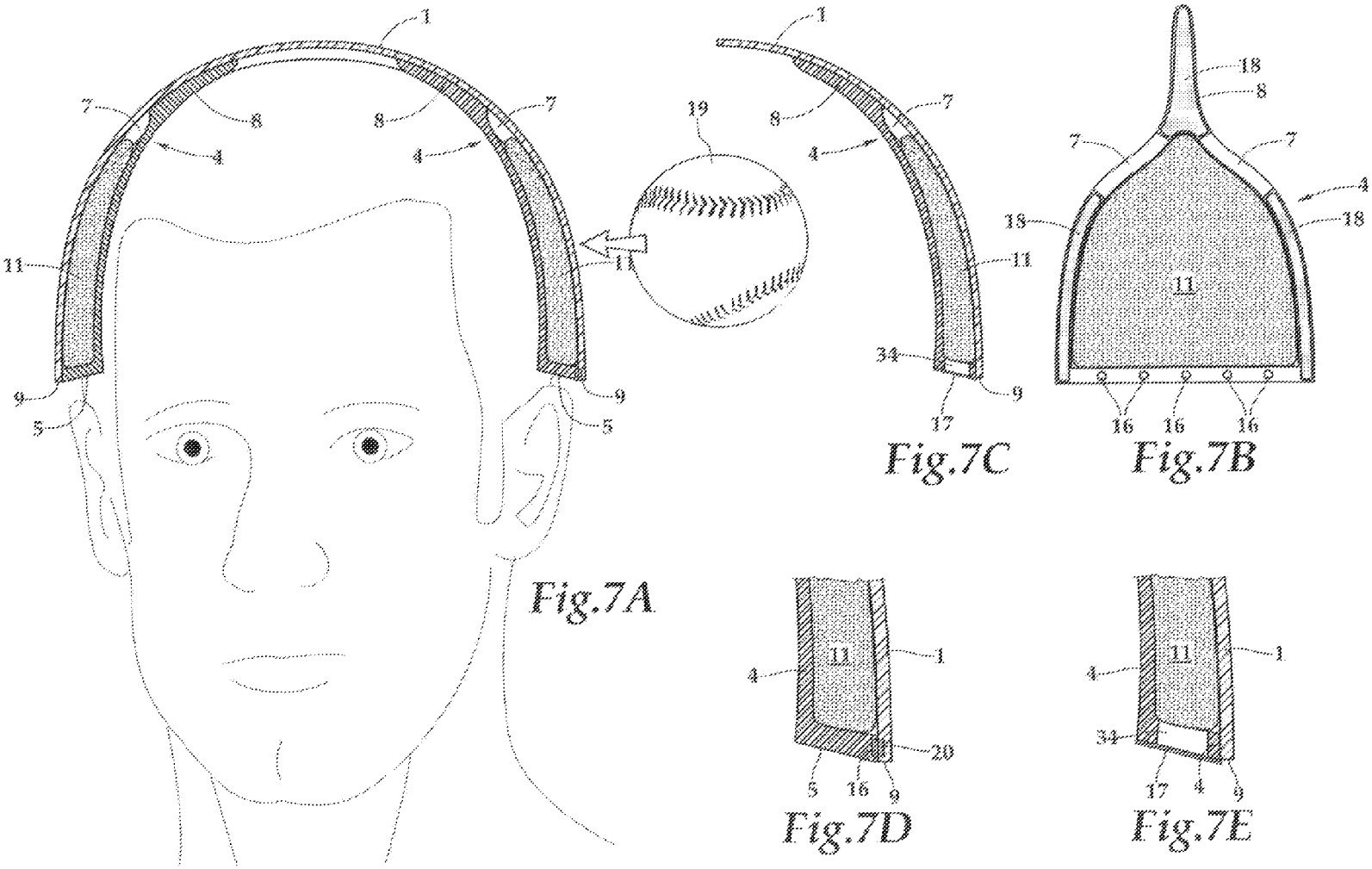
FIG. 7A is a diagram of a person wearing a helmet with the energy management system of the present invention shown in relation to a baseball.
FIG. 7B is a plan view of the first embodiment of the bell-shaped foam pocket with the bell-shaped bladder inside of the foam pocket.
FIG. 7C is a side cross-section view of the second embodiment of the bell-shaped foam pocket with the bell-shaped bladder inside of the foam pocket.
FIG. 7D is a detail cross-section view of the bell-shaped foam pocket and bell-shaped bladder shown in FIG. 7B.
FIG. 7E is a detail cross-section view of the bell-shaped foam pocket and bell-shaped bladder shown in FIG. 7C.

FIG. 7A is a diagram of a person wearing a helmet with the energy management system of the present invention shown in relation to a baseball. In this figure, the baseball 19 has not yet come into contact with the helmet 1. As such, the bladder 11 is shown in a relaxed state.

FIG. 7B is a plan view of the first embodiment of the bell-shaped foam pocket with the bell-shaped bladder inside of the foam pocket. This is the same embodiment shown in FIG. 6.

FIG. 7C is a side cross-section view of the second embodiment of the bell-shaped foam pocket with the bell-shaped bladder inside of the foam pocket. This is the same embodiment shown in FIG. 6A.

FIG. 7D is a detail cross-section view of the bell-shaped foam pocket and bell-shaped bladder shown in FIG. 7B. This figure shows the magnets 20 that are situated on the inside surface of the helmet shell 1. These magnets 20 are magnetically coupled to the magnets 16 on the foam pocket 4. The magnets 20 are preferably small, cylindrical ceramic magnets.

FIG. 7E is a detail cross-section view of the bell-shaped foam pocket and bell-shaped bladder shown in FIG. 7C.

Figures 8A, 8B, 8C, 8D, 8E:
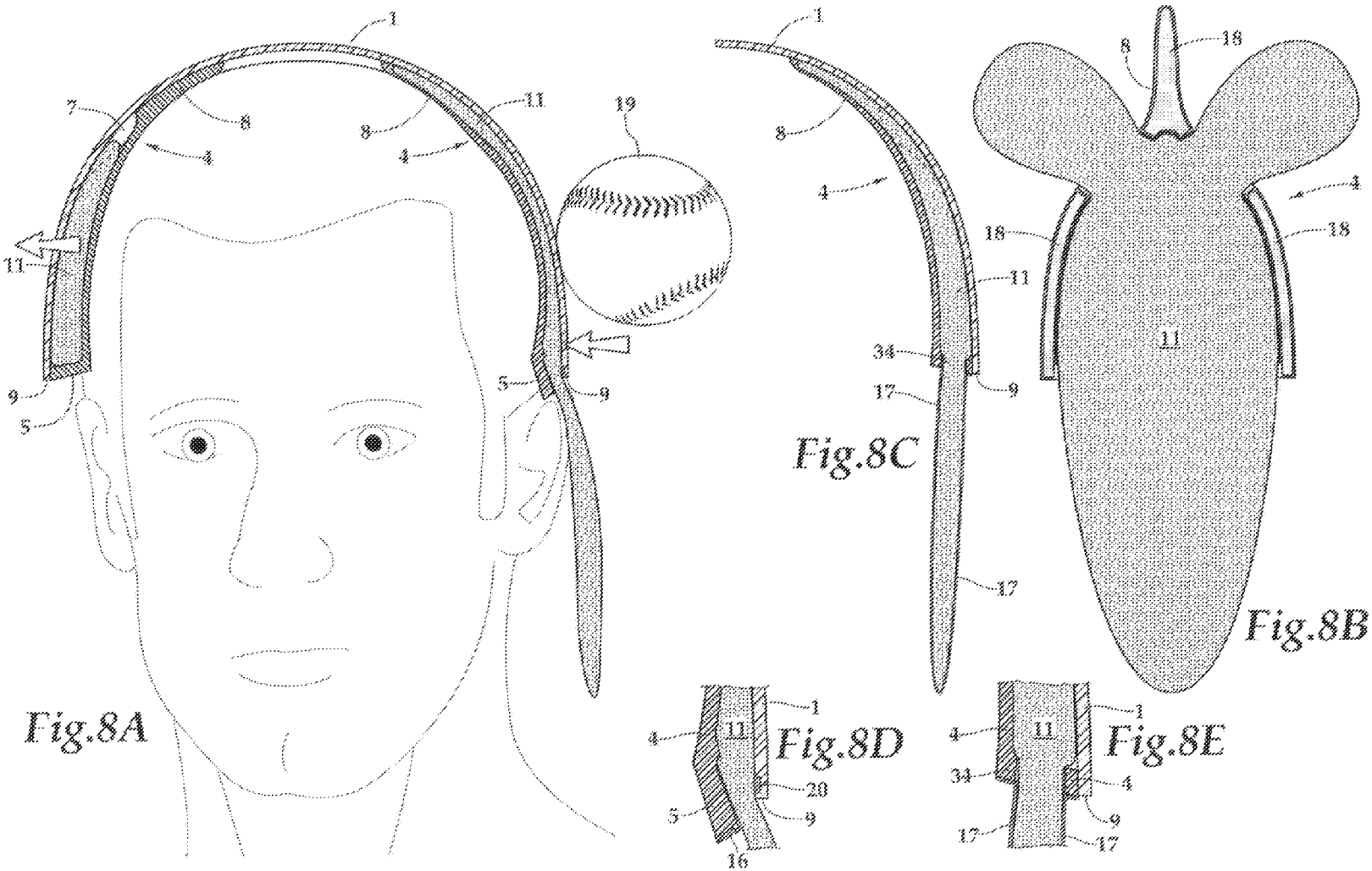
FIG. 8A is a diagram of a person wearing a helmet with the energy management system of the present invention shown at the point of impact with a baseball.
FIG. 8B is a plan view of the bell-shaped pocket shown in FIG. 7B with the bladder in a stretched and extended position.
FIG. 8C is a side cross-section view of the bell-shaped pocket shown in FIG. 7C with the bladder in a stretched and extended position.
FIG. 8D is a detail cross-section view of the bell-shaped pocket shown in FIG. 7D with the bladder in a stretched and extended position.
FIG. 8E is a detail cross-section view of the foam pocket shown in FIG. 7E with the bladder in a stretched and extended position.

FIG. 8A is a diagram of a person wearing a helmet with the energy management system of the present invention shown at the point of impact with a baseball. The helmet shell 1 is preferably sufficiently rigid that when the baseball 19 comes into contact with the helmet shell 1 at high speed, the helmet shell 1 either does not deform or deforms only slightly. The vast majority of the energy from the impact is absorbed by the bladder 11, which deforms and stretches around or away from the point of impact and extends both downward through the bottom surface 5 and upward through the throat areas 7 of the foam pockets 4 (see FIG. 8B). The curved side walls 6 and neck areas 8 of the foam pockets 4, which are adhered to the helmet shell 1, prevent the bladder from spreading generally in all directions and force it to stretch and extend downward (through the bottom surface 5 of the pocket 4) and out through the throat areas 7. Note that the helmet shell 1 also moves sideways on the wearer's head (to the left in this figure), as shown by the arrows, to compensate for the depression of the bladder 11 associated with the impact.

FIG. 8B is a plan view of the bell-shaped pocket shown in FIG. 7B with the bladder in a deformed, stretched and extended position. This figure clearly shows stretching and extension of the bladder 11 out through the throat areas 7 of the foam pocket 4. If the throat areas 7 are positioned in the vicinity of a ventilation hole 3, then it is possible that the bladder 11 may extend outside of the helmet shell 1 through a ventilation hole 3. Note that the extension and retraction of the bladder 11 back to the position shown in FIGS. 7A-7E is virtually instantaneous and occurs within fractions of a second. Thus, although the bladder is able to deform, stretch and extend beyond the confines of the helmet 1, it does not remain in that position for very long.

FIG. 8C is a side cross-section view of the bell-shaped pocket shown in FIG. 7C with the bladder in an extended position. For purposes of illustration, the bladder 11 is shown as having stretched a certain distance beyond the bottom edge 9 of the helmet; however, this figure should not be interpreted as limiting in any manner the distance by which the bladder 11 stretches. Depending on the force with which the baseball 19 (or other object) hits the helmet 1, the bladder 11 may deform, stretch and extend more or less than the distance shown in FIG. 8C.

FIG. 8D is a detail cross-section view of the bell-shaped pocket shown in FIG. 7D with the bladder in an extended position. Note that the magnets 16 on the foam pocket 4 have been decoupled from the magnets 20 on the inside surface of the helmet by the downward force of the stretching bladder 11.

FIG. 8E is a detail cross-section view of the foam pocket shown in FIG. 7E with the bladder in an extended position. Note that the thin, stretchy material 17 stretches downward with the bladder 11.

Figure 9:
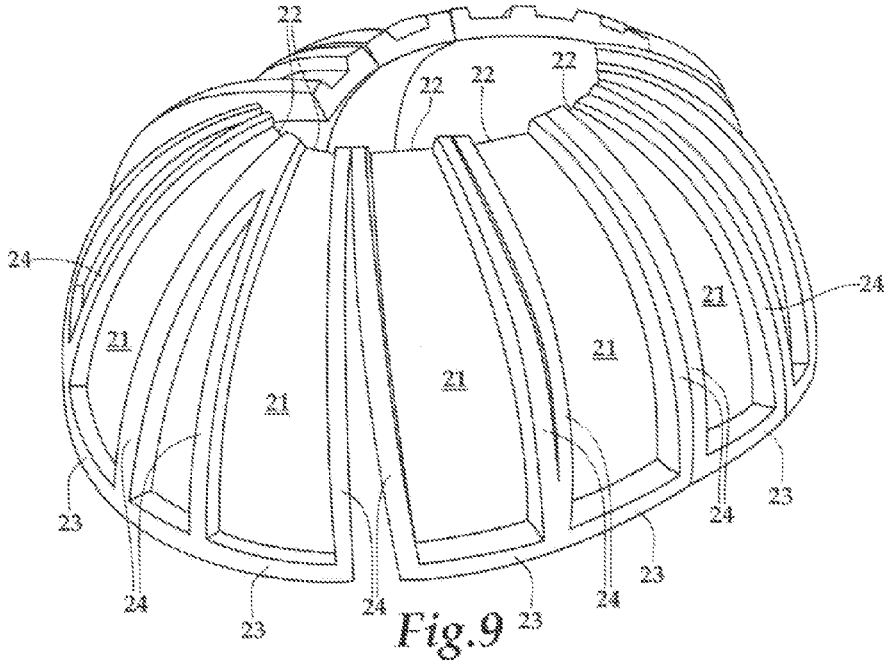
FIG. 9 is a perspective view of a first alternate embodiment of the foam pockets of the present invention.

FIG. 9 is a perspective view of a first alternate embodiment of the foam pockets of the present invention. In this figure, rather than the bell-shaped pockets 4 of the previous embodiments, the foam pockets 21 extend all of the way from the bottom edge 9 of the helmet 1 (not shown) to the top of the helmet 1 (not shown). In this embodiment, the top edge 22 of each pocket 21 is open so that the bladder may extend upward and out of the pocket (and possibly into or through a ventilation hole 3). The bottom edge 23 of each pocket 21 may be glued to the inside surface of the helmet shell 1, or it may be magnetically coupled to the inside surface of the helmet shell 1, as described above. If the bottom edge 23 of the pocket 21 is glued to the inside surface of the helmet shell 1, then the bottom surface 25 (see FIG. 10) of the pocket 4 is preferably comprised of a thin, stretchy material (not shown), as previously described. In the embodiment shown in FIG. 9, the side walls 24 of the foam pockets 21 are preferably glued or otherwise adhered to the inside surface of the helmet shell 1 so that the bladders (not shown) contained within the foam pockets 21 are primarily directed to stretch and extend upward or downward.

Figure 10:
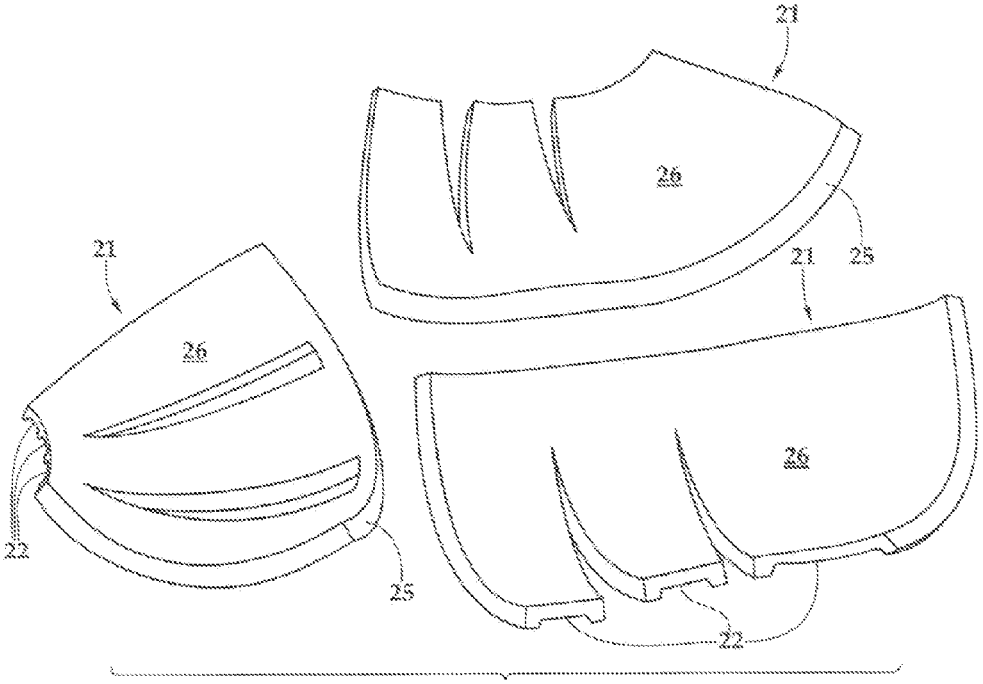
FIG. 10 is an illustration of the underside of the foam pockets shown in FIG. 9.

FIG. 10 is an illustration of the underside of the foam pockets shown in FIG. 9. In this figure, the pockets 21 are molded in groups so that the bottom edges 23 of the pockets 21 are contiguous. The underside 26 of the pockets 21 would be against the wearer's head when the pockets 21 are installed on the inside surface of the helmet shell 1.

Figure 11:
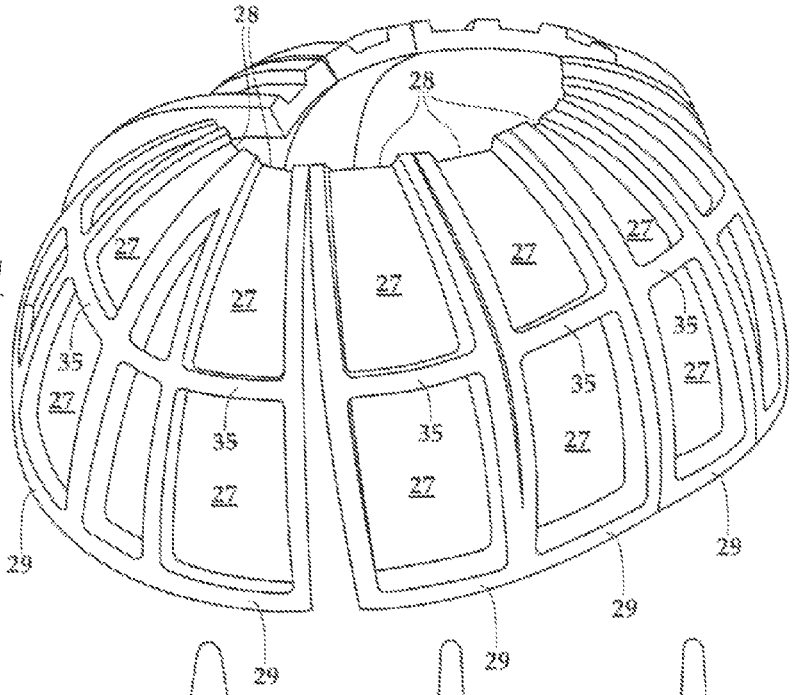
FIG. 11 is a perspective view of a second alternate embodiment of the foam pockets of the present invention.

FIG. 11 is a perspective view of a second alternate embodiment of the foam pockets of the present invention. In this embodiment, the foam pockets 27 are vertically stacked, with one pocket situated directly above another. Another way to view this embodiment is that the vertically oriented pockets 21 of the previous embodiment have been divided into two "stacked" pockets. In this embodiment, the top edges 28 of the pockets 27 along the top part of the helmet 1 (not shown) are open.

The center wall 35, which is oriented horizontally between the stacked pockets 27, may be magnetically coupled to the inside surface of the helmet 1, as previously described. Alternately, it may be comprised of a thin, stretchy material (not shown) that allows the bladders (not shown) inside of these pockets 27 to stretch and extend. The bottom edges 29 of the pockets 27 along the bottom part of the helmet 1 (not shown) may be glued to the helmet 1 or magnetically coupled to the inside surface of the helmet 1, as previously described. If the bottom edges are glued to the helmet, then the bottom surfaces (not shown) of the pockets 27 along the bottom part of the helmet 1 are preferably comprised of a thin, stretchy material (not shown) that allows the bladders (not shown) inside of these pockets 27 to extend downward.

Figure 12A:
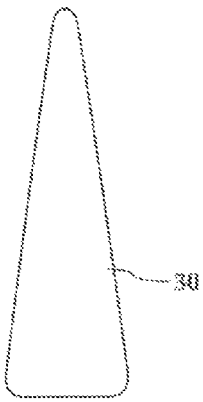
FIG. 12A is a plan view of a first embodiment of a bladder that would fit within the foam pockets shown in FIG. 9.
Figure 12B:
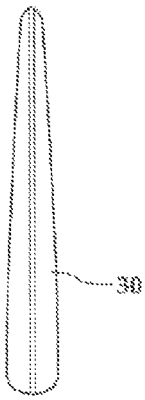
FIG. 12B is a side view of the bladder shown in FIG. 12A.

FIG. 12A is a plan view of a first embodiment of a bladder that would fit within the foam pockets shown in FIG. 9, and FIG. 12B is a side view of the bladder shown in FIG. 12A. The present invention is not limited to any particular size or shape of the bladder, as long as it fits within the confines of the pocket used in a particular embodiment. Similarly, the present invention is not limited to any particular size, shape or number of pockets.

Figure 13A:
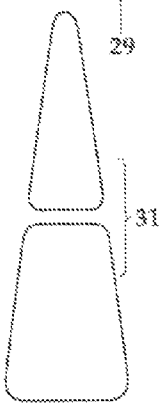
FIG. 13A is a plan view of a first embodiment of a pair of bladders that would fit within the room pockets shown in FIG. 11.
Figure 13B:
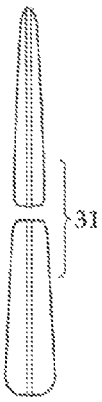
FIG. 13B is a side view of the pair of bladders shown in FIG. 13A.

FIG. 13A is a plan view of a first embodiment of a pair of bladders that would fit within the foam pockets shown in FIG. 11, and FIG. 13B is a side view of the pair of bladders shown in FIG. 13A. The present invention is not limited to any particular size or configuration of the bladder 31, as long as it fits within the confines of the pocket 27.

Figure 14A:
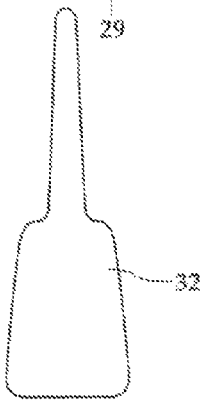
FIG. 14A is a plan view of a second embodiment of a bladder that would fit within the foam pockets shown in FIG. 9.
Figure 14B:
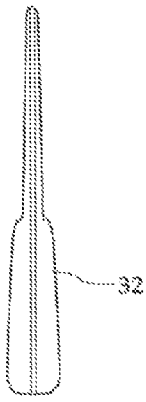
FIG. 14B is a side view of the bladder shown in FIG. 14A.

FIG. 14A is a plan view of a second embodiment of a bladder that would fit within the foam pockets shown in FIG. 9, and FIG. 14B is a side view of the bladder shown in FIG. 14A. The present invention is not limited to any particular size or configuration of the bladder 32, as long as it fits within the confines of the pocket 21.

Figure 15A:
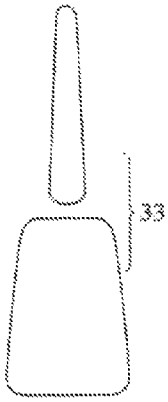
FIG. 15A is a plan view of a second embodiment of a pair of bladders that would fit within the foam pockets shown in FIG. 11.
Figure 15B:
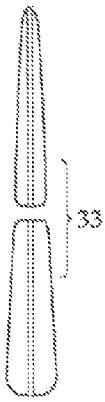
FIG. 15B is a side view of the pair of bladders shown in FIG. 15A.

FIG. 15A is a plan view of a second embodiment of a pair of bladders that would fit within the foam pockets shown in FIG. 11, and FIG. 15B is a side view of the pair of bladders shown in FIG. 15A. The present invention is not limited to any particular size or configuration of the bladder 33, as long as it fits within the confines of the pocket 27.

Note that in all of the bladder configurations shown, the bottom of the bladder is preferably thicker than the top of the bladder. In addition, in all of the embodiments described above and shown in the figures, the pockets cover at least half of the inside surface of the helmet shell. This is a preferred, but not required, feature of the present invention.

In all of the above embodiments, two methods of configuring the pockets to allow the bladder to extend beyond the bottom surface of the pocket are described —magnets and stretchy material. The present invention is not limited to these two methods, however, and is intended to encompass any method by which the bladder is allowed to extend beyond the bottom surface of the pocket. At all times, the side walls and (in the case of the bell-shaped pocket) neck area of the pocket act to stabilize and contain the bladder. Other than at the moment of impact, the bottom surface of the pocket also acts to contain (and stabilize) the bladder. If foam stabilizers 10 are used, the thickness of the pockets (that is, the thickness of the side walls and bottom surface of the pockets) is preferably comparable to the thickness of the foam stabilizers.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. An energy management system comprising:

(a) a helmet shell having a bottom edge;

(b) a plurality of bell-shaped pockets situated on an inside surface of the helmet shell, each of the bell-shaped pockets having a bottom surface; and (c) a bladder positioned inside of each bell-shaped pocket;

wherein the bottom surface of each bell-shaped pocket is configured to allow the bladder to extend beyond the bottom surface of the pocket and beyond the bottom edge of the helmet upon impact.

2. The energy management system of claim 1, wherein each bell-shaped pocket further comprises a first curved side wall, a second curved side wall, a neck area a first throat area, and a second throat area;

wherein the first curved side wall extends from the bottom surface to the first throat area, and the second curved side wall extends from the bottom surface to the second throat area;

wherein the first throat area is situated between the first curved side wall and the neck, and the second throat area is situated between the second curved side wall and the neck; and wherein the first and second curved side walls and the neck area are affixed to the inside surface of the helmet shell, and wherein the first and second throat areas are configured to allow the bladder to extend outside of the pocket through the first and second throat areas upon impact.

3. The energy management system of claim 1, wherein each bladder comprises a vertical groove that extends downward along a vertical axis of the bladder from an apex of the bladder to a point between the apex and a center point on the vertical axis.

4. An energy management system comprising:

(a) a helmet shell having a bottom edge and a top;

(b) a plurality of pockets situated on an inside surface of the helmet shell and extending from the bottom edge of the helmet shell to the top of the helmet shell, each pocket having a bottom surface and a top edge that is open to the top of the helmet shell; and (c) a bladder positioned inside of each pocket;

wherein the bottom surface of each pocket is configured to allow the bladder to extend beyond the bottom surface of the pocket and beyond the bottom edge of the helmet upon impact.

5. The energy management system of claim 4, wherein each pocket comprises a first side wall and a second side wall, and wherein the first and second side walls are affixed to the inside surface of the helmet shell.

6. The energy management system of claim 4, wherein the pockets cover at least half of the inside surface of the helmet shell.

7. An energy management system comprising:

(a) a helmet shell having a bottom edge and a top;

(b) a first row of pockets and a second row of pockets situated on an inside surface of the helmet shell, the first row of pockets being situated on top of the second row of pockets, each pocket in the first row having a top edge that is open to the top of the helmet, and each pocket in the second row having a bottom surface; and (c) a bladder positioned inside of each pocket in the first row of pockets and each pocket in the second row of pockets;

wherein the bottom surface of each pocket in the second row of pockets is configured to allow the bladder within the pocket to extend beyond the bottom surface of the pocket and beyond the bottom edge of the helmet upon impact.

8. The energy management system of claim 7, further comprising a center wall between each pocket in the first row of pockets and each pocket in the second row of pockets;

wherein the center wall is configured to allow the bladder within each of the pockets in the first row of pockets and the bladder within each of the pockets in the second row of pockets to extend beyond the center wall.

9. The energy management system of claim 7, wherein each pocket in the first row of pockets comprises a first side wall and a second side wall, each pocket in the second row of pockets comprises a first side wall and a second side wall, and wherein the first and second side walls of the pockets in the first and second rows are affixed to the inside surface of the helmet shell.

10. The energy management system of claim 7, wherein the pockets in the first and second rows cover at least half of the inside surface of the helmet shell.

11. The energy management system of claim 1, 4 or 7, wherein the bladder has a top and a bottom, and the bladder is thicker at the bottom than at the top.

12. An energy management system comprising:

(a) a helmet shell having a bottom edge;

(b) at least one pocket situated on an inside surface of the helmet shell and having a bottom surface; and (c) a bladder positioned inside of the at least one pocket;

wherein the bottom surface of each pocket is aligned with the bottom edge of the helmet shell; and wherein the bottom surface of each pocket is configured to allow the bladder to extend beyond the bottom surface of the pocket and beyond the bottom edge of the helmet upon impact.

* * * * *